US005292297A

United States Patent [19]

Hsu

[11] Patent Number: 5,292,297

[45] Date of Patent: Mar. 8, 1994

[54] EXERCISE DEVICE

[76] Inventor: Sam Hsu, No. 35, Lane 156, Sung Chiang Rd., Taipei, Taiwan

[21] Appl. No.: 63,536

[22] Filed: May 18, 1993

[51] Int. Cl.[5] ..... A63B 23/04

[52] U.S. Cl. ..... 482/146; 482/94; 482/145

[58] Field of Search ..... 108/25, 26, 125; 482/145, 146, 147, 148, 35, 39, 52, 70, 121, 142, 140, 141, 904

[56] References Cited

U.S. PATENT DOCUMENTS

| | | | |
|---|---|---|---|
| 137,983 | 4/1873 | Wanzer | 108/25 |
| 4,109,909 | 8/1978 | Csutor | 482/146 |
| 4,386,915 | 6/1983 | Gilliam | 482/146 |
| 4,787,630 | 11/1988 | Watson et al. | 482/146 |
| 4,801,140 | 1/1989 | Bergeron | 482/146 |

*Primary Examiner*—Stephen R. Crow
*Assistant Examiner*—Jerome Donnelly
*Attorney, Agent, or Firm*—Hedman, Gibson & Costigan

[57] ABSTRACT

An exercise device has a board wherein an oval recess is formed. A circular recess is formed in the oval recess. An oval plate has a first side and a second side on which a disk is rotatably attached. The oval plate is receivable in the oval recess. The disk is receivable in the circular recess. The first side of the plate and the upper side of the board form a plain surface on which the exerciser can do sit-ups when the oval plate is received in the oval recess and the disk is received in the circular recess. When the oval plate is received in the recess with the second side thereof exposed, there is exposed the disk on which exercisers can stand and twist.

3 Claims, 3 Drawing Sheets

EXERCISE DEVICE

BACKGROUND OF INVENTION

1. Field of Invention

The present invention relates to an exercise device.

2. Related Prior Art

In modern life, many people are under great pressure to achieve success by working hard for long hours. As a result of this, they sacrifice time which should be spent on other activities, such as exercising, because this has a low priority compared to working. Even though some people want to exercise, it may be difficult to find enough space for exercise in urban areas. For those who wish to exercise and only have limited space, the present invention provide& an exercise device.

SUMMARY OF INVENTION

It is an object of the present invention to provide an exercise device on which exercisers can do sit-up exercises.

It is another object of the present invention to provide an exercise device on which exercisers can do twist exercises.

It is still another object of the present invention to provide an exercise device which has a board wherein an oval recess is formed. A circular recess is formed in the oval recess. An oval plate has a first side and a second side on which a disk is rotatably attached. The oval plate is receivable in the oval recess. The disk is receivable in the circular recess. The first side of the plate and the upper side of the board form a plain surface on which the exerciser can do sit-ups when the oval plate is received in the oval recess and the disk is received in the circular recess. When the oval plate is received in the recess with the second side thereof exposed, there is exposed the disk on which exercisers can stand and twist.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
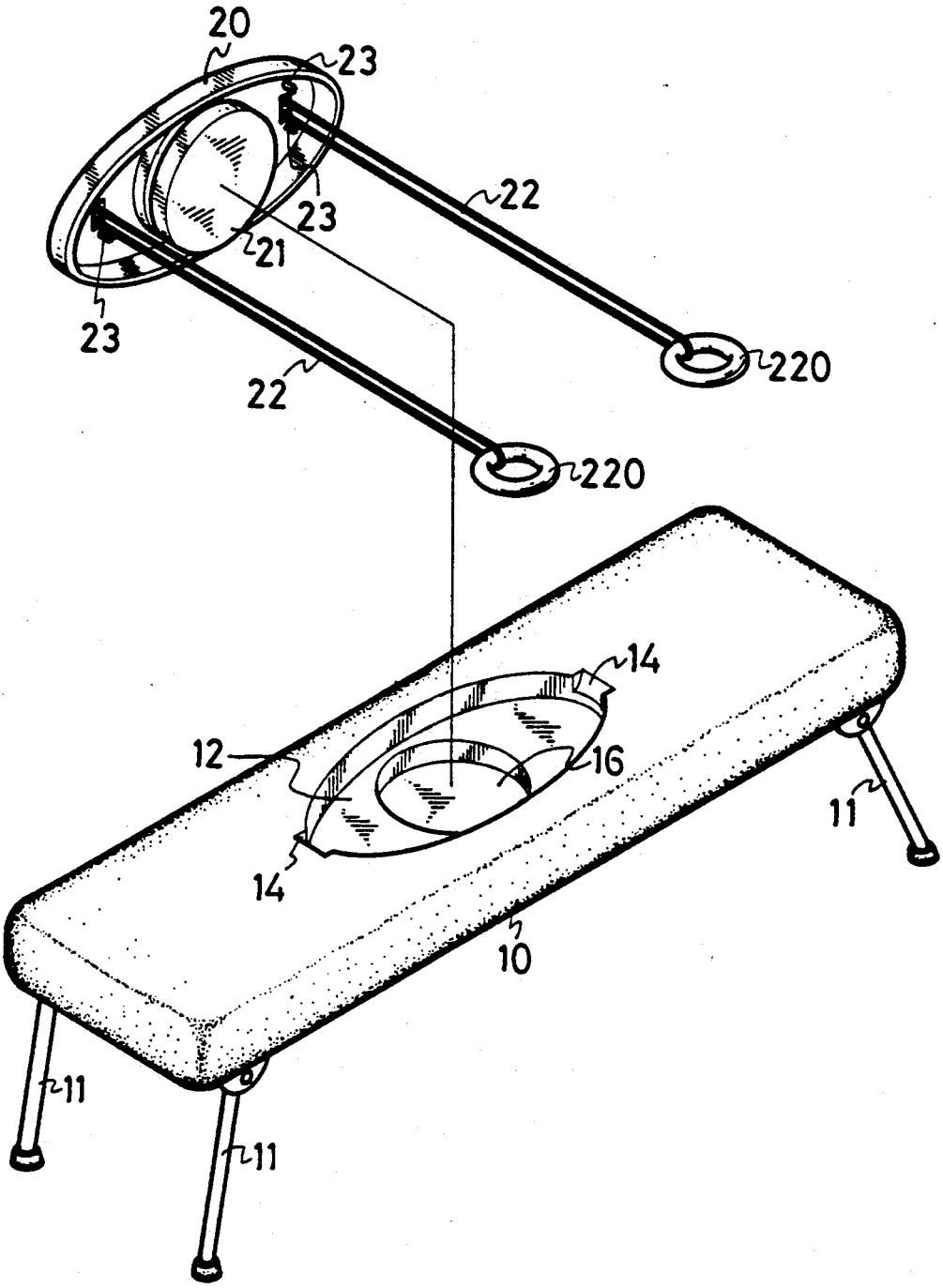
FIG. 1 is an exploded view of an exercise device in accordance with the preferred embodiment of the present invention.

Initially referring to FIG. 1 of the drawings, an exercise device has a board 10 under which four legs 11 are pivotally attached so that the legs 11 are foldable towards the board 10 for the storing thereof.

A recess 12 is formed in the board 10. The recess 12 is defined by means of a bottom and a wall extending along an oval having a long axis being parallel to a length of the board 10. Each of the two cutouts 14 is formed at a corresponding one of the ends of the long axis of the oval. A recess 16 is formed in the bottom of the recess 12. The recess 16 is defined by means of a bottom and a wall extending along a circle.

The exercise device also has a plate 20 having a first side and a second side on which a disk 21 is rotatably attached. As seen in a top view, the plate 20 has a profile corresponding to that of the recess 12 so that the plate 20 is receivable in the recess 12. As seen in a top view, the disk 21 has a profile corresponding to that of the recess 16 so that the disk 21 is receivable in the recess 16. Each of two extension elements 22 has a first end attached to the second side of the plate 20 and a second end attached to a ring 220. Two pairs of rods 23 are formed on the second side of the plate 20.

Figure 2:
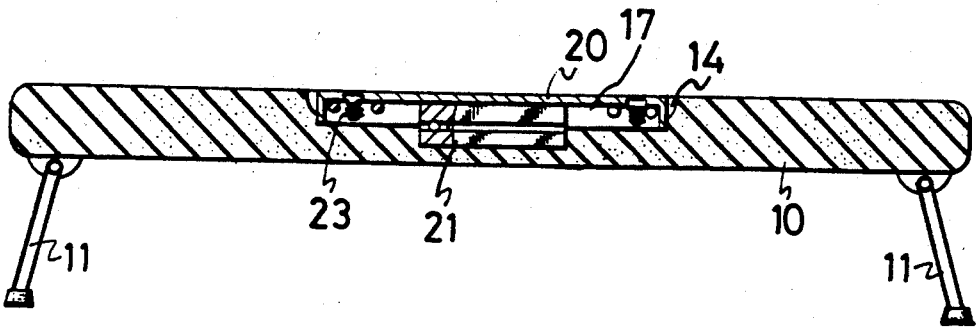
FIG. 2 is a cross-sectional view of the exercise device in accordance with the preferred embodiment of the present invention, showing a plate and a disk sited in a first position on a board.

Additionally referring to FIG. 2 of the drawings, the plate 20 is received in the recess 12 and the disk 21 is received in the recess 16 so that the first side of the plate 20 is exposed. A periphery is formed on the second side of the plate 20. The periphery formed about the plate 20 has a height identical to that of the wall defining the recess 12 so that the first side of the plate 20 and the upper side of the board 10 form a plain surface on which exercisers can do sit-up. Each of the extension elements 22 is wound about a corresponding one of the pairs of rods 23 for storage.

Figure 3:
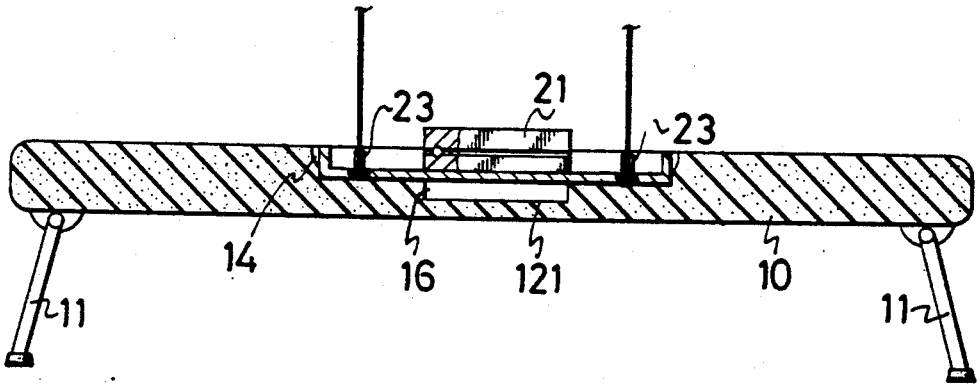
FIG. 3 is a view similar to FIG. 2, but showing the plate and the disk in a second position on the board.
Figure 4:
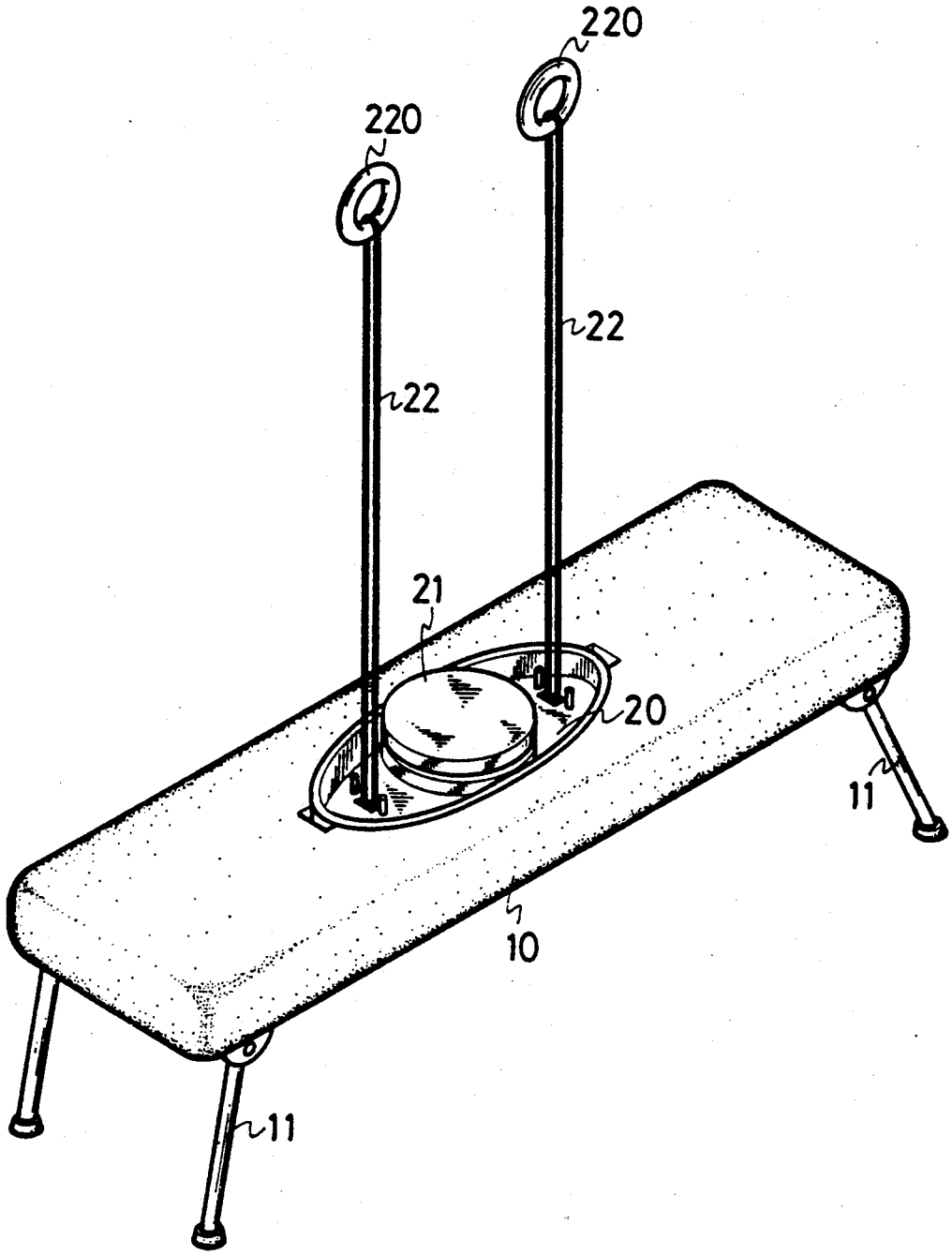
FIG. 4 is a perspective view of an exercise device in accordance with the preferred embodiment of the present invention, showing the plate and the disk sited in the second position on the board.

Additionally referring to FIG. 3 of the drawings, the plate 20 is received in the recess 12 with the second side thereof exposed so that the disk 21 is exposed. The extension elements 22 are unwound from the pairs of rods 23 when required. Exercisers can stand on the plate 21 while they grip the rings 220 with their hands. The exercisers can twist on the disk 21 which is attached to the plate 20 which is firmly received in the recess 12. The exercisers retain their balance by means of the extension elements 22.

The cutouts 14 are formed as access points for the fingers of the exercisers for disengaging the plate 20 from the recess 12 so that the plate 20 can be changed between the position as shown in FIG. 2 and the position as shown in FIG. 3.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. An exercise device comprising:

a board comprising an upper side and a lower side;

a first non-circular recess formed in said board;

a second recess formed in said non-circular recess;

a plate comprising a first side and a second side and being receivable in said first recess so that it is kept from rotating relative to said board;

a disk rotatably attached to said second side of said plate, said disk comprising a first position such that it is received in said second recess and that said first side of said plate and said upper side of said board form a plain surface on which exercisers can do sit-ups and a second position such that said disk is exposed and that exercisers can twist thereon.

2. An exercise device in accordance with claim 1, further comprising two extension elements each comprising a first end attached to said second side of said plate and a second end attached to a corresponding one of two rings so that the exercisers can retain their balance with their hands gripping said rings while they are twisting.

3. An exercise device in accordance with claim 1, further comprising four legs pivotally attached to said board.

* * * * *